US005111109A

United States Patent [19]

Yagi et al.

[11] Patent Number: 5,111,109

[45] Date of Patent: May 5, 1992

[54] DISCHARGE TUBE FOR SERIES GAP USE IN IGNITION APPARATUS

[75] Inventors: Kiyoshi Yagi; Seiichi Wakabayashi, both of Shizuoka, Japan

[73] Assignee: Yazaki Corporation, Tokyo, Japan

[21] Appl. No.: 723,885

[22] Filed: Jul. 1, 1991

[30] Foreign Application Priority Data

Jul. 11, 1990 [JP] Japan ..... 2-72976

[51] Int. Cl.[5] ..... H01J 17/06; H01J 17/10; H01J 17/18

[52] U.S. Cl. ..... 313/622; 313/124; 313/574; 313/624; 313/632

[58] Field of Search ..... 313/632, 124, 135, 576, 313/573, 51, 622, 621, 624, 574, 634

[56] References Cited

U.S. PATENT DOCUMENTS 1,302,319 4/1919 Cronin ..... 313/135 X
3,465,194 9/1969 Hall ..... 313/622
3,898,533 8/1975 Scudner, Jr. ..... 317/61

FOREIGN PATENT DOCUMENTS 6140 of 1904 United Kingdom ..... 313/124
0361357 4/1990 European Pat. Off. .

*Primary Examiner*—Palmer C. DeMeo
*Attorney, Agent, or Firm*—Armstrong, Nikaido, Marmelstein, Kubovcik & Murray

[57] ABSTRACT

The discharge tube has an insulating tube formed into a hollow cylinder with one end open and the other closed. An anode electrode, which is formed as a flanged electrode, is hermetically fitted to the open end of the insulating tube and a cathode electrode, which is formed as a bar electrode, is embedded in the closed end of the insulating tube so that only the front end surface of the bar electrode faces the interior of the insulating tube. This construction allows no redundant space within the insulating tube other than the dishcarge space, so that the discharge tube can be minimized in size. This construction also permits a discharge only between the front end of the bar electrode and the inner end of the flanged electrode, stabilizing the electron emission passage or discharge path and therefore the discharge voltage.

2 Claims, 2 Drawing Sheets

DISCHARGE TUBE FOR SERIES GAP USE IN IGNITION APPARATUS

BACKGROUND OF THE INVENTION

1. Field of the Invention

The present invention relates to a discharge tube and more particularly to a discharge tube suitably applied to a series gap ignition apparatus in automotive engines.

2. Description of the Prior Art

An ignition apparatus C for automotive engines as shown in FIG. 3 has come to be known in recent years. In this ignition apparatus (as described in the Japanese Patent Publication No. Showa 51-32180), what is generally called a series gap S is provided in series with an ignition plug 1 to prevent the ignition plug 1 from smoldering due to adhering carbons and thereby keep the ignition timing constant. It is being thought of to form the series gap S with a so-called discharge tube 2, which is sealed with an inert gas and applied with a voltage between electrodes at each end of the tube to cause a discharge.

FIG. 4 shows a above-mentioned conventional discharge tube 2, which is installed in a plug cap (not shown) that is removably mounted to the ignition plug 1. The discharge tube 2 has a casing 3 as a hollow cylindrical insulating tube that is formed of ceramics. The casing 3 consists of a body portion 3*a* which at one end is closed inwardly and at the other end open, and a cover portion 3*b* that fits airtightly onto the open end of the body portion 3*a*. At each end of the casing 3 are formed openings 4, into which a pair of Rogowskii type perforated electrodes 6 or so-called flanged electrodes are fitted and projected toward each other, with a specified distance, i.e., a series gap S provided inside the casing 3 between the facing ends of the electrodes. The flanged electrode 6 has its base portion 6*a* attached to an electrode cap 5 that covers the opening 4. One of the electrode caps 5 is attached with a sealing pipe 7 through which an inert gas such as argon is loaded and sealed.

In the conventional discharge tube 2 mentioned above, the pair of electrodes 6 hermetically fitted to the casing 3 are equal in shape so that the discharge tube itself has no directivity. Thus when a voltage is applied across the electrodes 6, with one electrode taken as an anode and the other as a cathode, a discharge occurs between the tips 6*b* or inner ends of the electrodes 6, i.e., in the series gap S. The discharge voltage in the series gap S is kept at a relatively high level to apply the high voltage after discharge to the electrodes of the ignition plug 1 so that an ignition voltage required by the ignition apparatus C can be produced without being much affected by carbons adhering to the ignition plug 1.

In the above conventional discharge tube 2, however, since the pair of flanged electrodes 6 are projected into the casing 3 toward each other with a specified gap therebetween, the inner space of the casing 3 is larger than the discharge space between the electrode tips 6*b*. This in turn makes large the discharge tube 2 and therefore the plug cap that contains the discharge tube 2, making it impossible to reduce the size of the ignition apparatus.

Another problem is that while the discharge is considered to occur theoretically between the electrode tips 6*b* whose distance is the shortest, there are rare cases where the discharge occurs not between the electrode tips 6*b* but between the base portions 6*a*. Such an unstable discharge passage in the discharge tube 2 results in an unstable discharge voltage, which in turn gives rise to a problem that the ignition apparatus C may in some cases not be able to get the required ignition voltage.

SUMMARY OF THE INVENTION

This invention has been accomplished with a view to overcoming the above-mentioned drawbacks. A primary object of the invention is to provide a discharge tube which can be reduced in size to reduce the size of the plug cap that accommodates the discharge tube, thereby allowing a reduction in the overall size of the ignition apparatus. Another object of the invention is to provide a discharge tube which can stabilize the discharge path therein to keep the discharge voltage stable at all times.

To achieve the above objectives the discharge tube according to this invention comprises: an insulating tube in which an inert gas is sealed, the insulating tube being formed as a cylinder with one end open and the other closed; and a pair of electrodes, one acting as an anode electrode and the other as a cathode electrode, the anode electrode being formed as a flanged electrode, the cathode electrode being formed as a bar electrode, the flanged electrode being hermetically fitted to the open end of the insulating tube, the bar electrode being embedded in the closed end of the insulating tube so that the front end surface of the bar electrode faces the interior of the insulating tube, the anode and cathode electrodes being applied with a voltage to cause a discharge between the pair of opposing electrodes.

In this invention, the insulating tube is formed as a cylinder with one end open and the other closed. The anode electrode is formed as a flanged electrode and the cathode electrode as a bar electrode. The flanged electrode is hermetically fitted to the open end of the insulating tube, while the bar electrode is embedded in the closed end of the insulating tube so that the front end surface of the bar electrode faces the interior of the insulating tube. With this arrangement, the space between the front end of the bar electrode and the inner end of the flanged electrode constitutes a so-called discharge space. Since there is no redundant space in the insulating tube other than the discharge space, the discharge tube itself can be minimized in size.

Because of this construction, electrons during the discharge phenomenon are emitted only from the front end of the bar electrode and reach the inner end of the flanged electrode. The emitted electron path or discharge path can therefore be stabilized, ensuring a stable discharge voltage.

DETAILED DESCRIPTION OF PREFERRED EMBODIMENT

Figure 1:
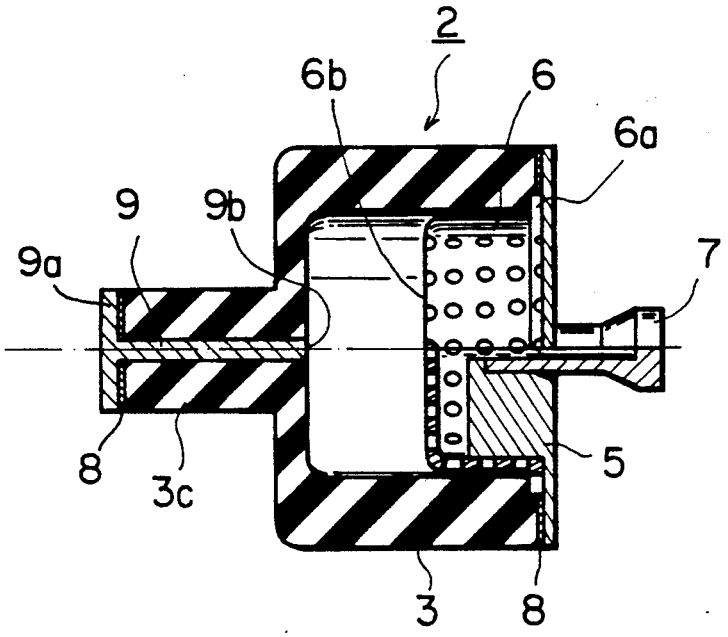
FIG. 1 is a cross section of one embodiment of a discharge tube according to this invention.

Embodiments of this invention will be described by referring to FIGS. 1 and 2, in which components that are identical with those of a conventional discharge tube are given like reference numerals.

FIG. 1 shows one embodiment of a discharge tube 2 according to this invention. A casing 3 as a ceramic insulating tube has its one end open and the other closed and is formed into a hollow cylinder. The open end is covered with an electrode cap 5. A perforated Rogowskii type electrode 6 or so-called flanged electrode whose base portion 6*a* is attached to the electrode cap 5 is hermetically fitted into the open end by solder 8. A small gap is formed between the outer surface of the electrode 6 and the inner wall surface of the casing 3 so that the electrode 6 contacts the casing 3 only at the base portion 6*a*, which seals the opening.

The closed end of the casing 3 is formed integral with an electrode holder 3*c*, which has a narrow bar electrode 9 embedded therein so that the front end surface 9*b* of the bar electrode 9 faces the interior of the casing 3. The bar electrode 9 is preferably formed of such materials as Ni-Fe alloy or Co-Ni-Fe alloy that have almost the same thermal expansion coefficient as ceramics which is the casing material. And its diameter should preferably be in the range of 1–3 mm. The base portion of the bar electrode 9 is formed as an electrode plate 9*a*, which is hermetically connected to the end surface of the electrode holder 3*c* by solder 8.

Denoted 7 is a sealing pipe through which to charge an inert gas such as argon into the casing 3.

Now, the operation of this invention will be described.

In this embodiment, the discharge tube 2 of the above construction is installed in the plug cap to form a series gap in series with the ignition plug. The series gap in the ignition apparatus prevents the ignition plug from smoldering as might occur due to adhering carbons, thus keeping the ignition timing constant. In the discharge tube 2, the perforated Rogowskii type electrode 6 as the flanged electrode is used as an anode and the bar electrode 9 as a cathode.

When in this condition a discharge occurs, electrons are emitted from the bar electrode 9. Since as mentioned above the bar electrode 9 is embedded in the electrode holder 3*c* with only the front end surface 9*b* facing the interior of the casing 3, electrons are released only from the front end surface 9*b* of the bar electrode 9 and reach the electrode tip 6*b* of the perforated Rogowskii type electrode 6. This stabilizes the electron emission path or the so-called discharge path during the discharge phenomenon, which in turn makes the discharge voltage very stable. The stabilized discharge voltage provides a necessary ignition voltage for the ignition apparatus at all times.

Furthermore, the anode electrode is the perforated Rogowskii type electrode 6 that serves as a so-called flanged electrode and is fitted to the open end of the casing 3 with a small gap between the inner wall surface of the casing and the electrode. The cathode electrode is the bar electrode 9 which is embedded in the closed end portion of the casing 3 so that only the front end surface 9*b* of the bar electrode 9 faces the interior of the casing 3. In this structure, the discharge occurs between the front end surface 9*b* of the bar electrode 9 and the inner electrode tip 6*b* of the perforated Rogowskii type electrode 6. This gap constitutes the so-called discharge space. In this embodiment, there is no other space formed in the casing 3 than this discharge space. This means that the space in the casing 3 of the discharge tube 2 is used only as the discharge space, allowing the discharge tube 2 to be reduced in size. This in turn permits a reduction in the size of the plug cap containing the discharge tube 2 and therefore of the entire ignition apparatus. Since the inner space of the casing 3 is used only as the discharge space, the amount of inert gas loaded into the casing 3 is minimal, thus reducing the overall manufacturing cost of the discharge tube 2.

Figure 2:
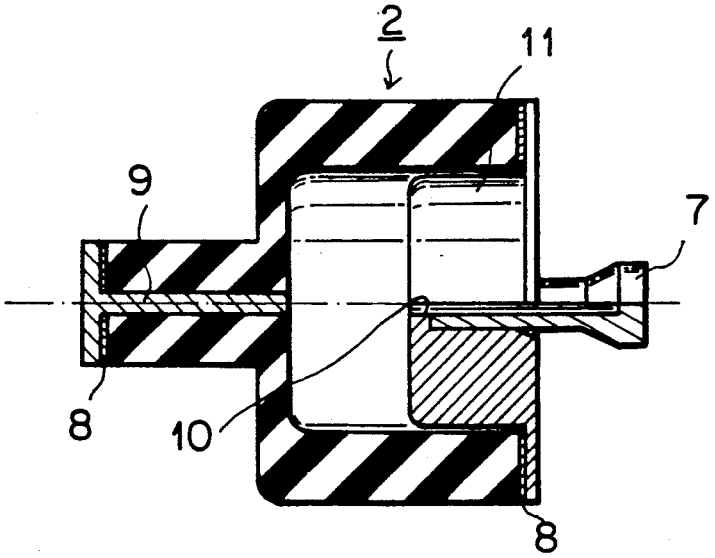
FIG. 2 is a cross section of another embodiment of this invention.
Figure 3:
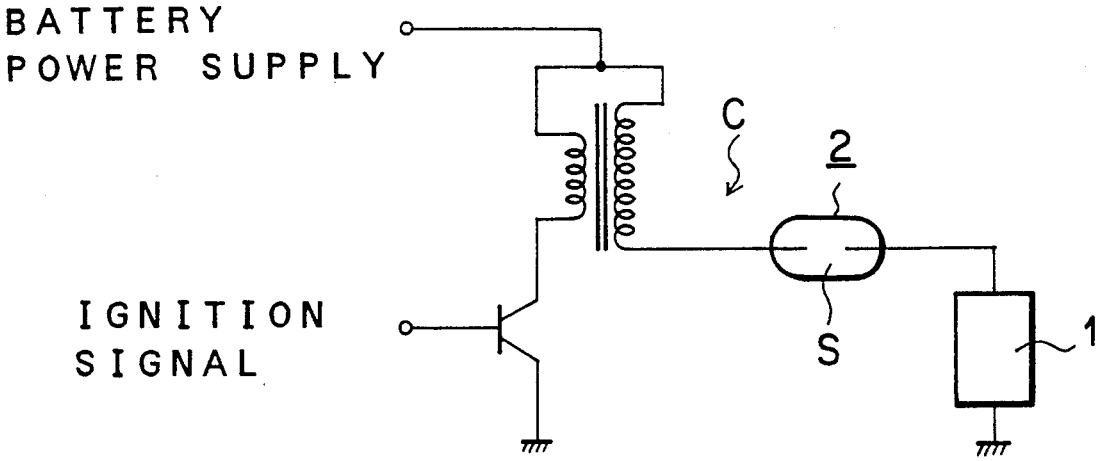
FIG. 3 is a schematic circuit diagram of a series gap ignition apparatus.
Figure 4:
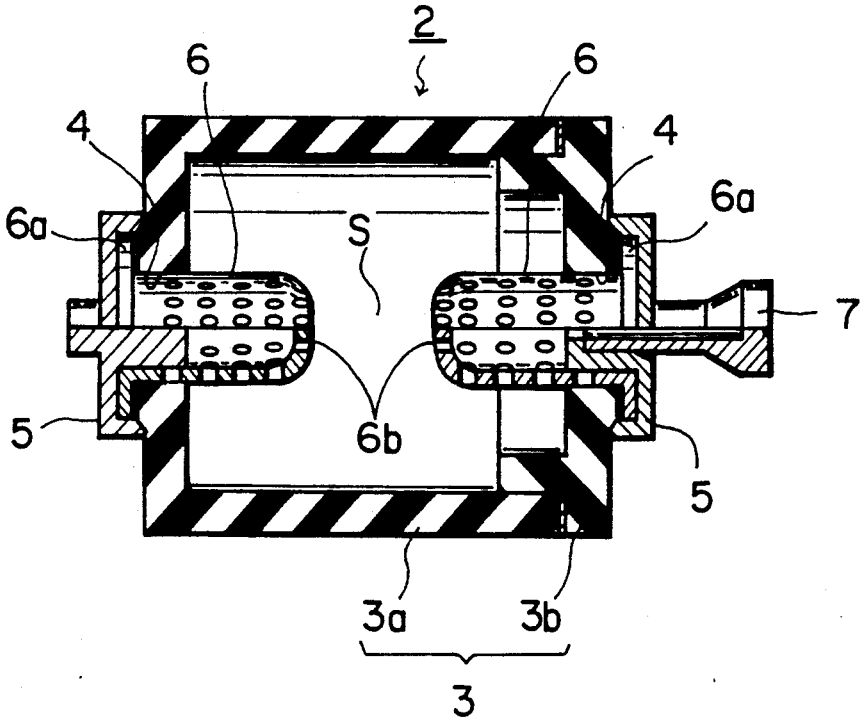
FIG. 4 PRIOR ART
FIG. 4 is a cross section of a conventional discharge tube.

FIG. 2 shows another embodiment of the invention. The anode electrode fitted to the open end of the casing 3 is a flanged electrode 11, rather than the perforated Rogowskii type electrode 6. The flanged electrode 11 has formed at a center of the tip inside the casing 3 a gas hole 10 that communicates with the gas sealing pipe 7. In other respects, this embodiment is similar to the preceding one.

This embodiment employs a flanged electrode as an anode electrode, instead of the Rogowskii type electrode which has a large number of holes formed therein. This makes the manufacture easy and less expensive. The electric field concentrates around the gas hole 10 formed at the electrode tip in the casing 3, thereby further stabilizing the discharge path between the bar electrode 9 as a cathode and the flanged electrode as an anode.

The structural features and advantages of this invention may be summarized as follows. The insulating tube is formed as a cylinder with one end open and the other closed. The anode electrode is formed as a flanged electrode while the cathode electrode is formed as a bar electrode. The flanged electrode is hermetically fitted to the open end of the insulating tube, and the bar electrode is embedded in the closed end portion of the insulating tube so that its front end faces the interior of the insulating tube. In this construction, the space between the inner ends of the bar electrode and the flanged electrode constitutes a so-called discharge space where a discharge occurs. No other redundant space than the discharge space is formed inside the insulating tube. In other words, the space in the insulating tube acts only as a discharge space. Hence, the discharge tube itself can be reduced in size, permitting the size reduction for the plug cap containing the discharge tube and also for the ignition apparatus as a whole.

During the discharge phenomenon, electrons are emitted only from the front end of the bar electrode to reach the inner end of the flanged electrode. As a result, the path of the emitted electrons or the discharge path can be stabilized, making the discharge voltage very stable. The stabilized discharge voltage in turn always ensures a necessary ignition voltage for the ignition apparatus.

What is claimed is:

1. A discharge tube comprising:

an insulating tube in which an inert gas is sealed, said insulating tube being formed as a cylinder with one end open and the other closed; and a pair of electrodes, one acting as an anode electrode and the other as a cathode electrode, said anode electrode being formed as a flanged electrode, said cathode electrode being formed as a bar electrode, said flanged electrode being hermetically fitted to the open end of the insulating tube, said bar electrode being embedded in the closed end of the insulating tube so that the front end surface of the bar electrode faces the interior of the insulating tube, said anode and cathode electrodes being applied with a voltage to cause a discharge between the pair of opposing electrodes.

2. A discharge tube as claimed in claim 1, wherein said flanged electrode is a Rogowskii type electrode which has a large number of perforations.

* * * * *